US009938949B2

(12) United States Patent
Kim et al.

(10) Patent No.: US 9,938,949 B2
(45) Date of Patent: Apr. 10, 2018

(54) CONTROL SYSTEM OF LOW PRESSURE FUEL PUMP FOR GASOLINE DIRECT INJECTION ENGINE AND METHOD THEREOF

(71) Applicant: Hyundai Motor Company, Seoul (KR)

(72) Inventors: Heesup Kim, Hwaseong-si (KR); Jeong Ho Kim, Suwon-si (KR)

(73) Assignee: Hyundai Motor Company, Seoul (KR)

( * ) Notice: Subject to any disclaimer, the term of this patent is extended or adjusted under 35 U.S.C. 154(b) by 139 days.

(21) Appl. No.: 14/340,178

(22) Filed: Jul. 24, 2014

(65) Prior Publication Data

US 2015/0144108 A1 May 28, 2015

(30) Foreign Application Priority Data

Nov. 26, 2013 (KR) ..... 10-2013-0144500

(51) Int. Cl.

| | |
|---|---|
| ***F02D 41/00*** | (2006.01) |
| ***F02M 69/54*** | (2006.01) |
| *F02D 41/38* | (2006.01) |
| *F02D 41/22* | (2006.01) |

(52) U.S. Cl.

CPC ..... *F02M 69/54* (2013.01); *F02D 41/3854* (2013.01); *F02D 41/3818* (2013.01); *F02D 2041/224* (2013.01); *F02D 2200/06* (2013.01); *F02D 2200/0602* (2013.01); *F02D 2200/0606* (2013.01); *F02D 2200/703* (2013.01); *F02D 2250/02* (2013.01)

(58) Field of Classification Search

CPC ..... F02M 69/54; F02D 41/3854; F02D 2041/224; F02D 2250/02; F02D 2200/06; F02D 41/3818; F02D 2200/703; F02D 2200/0602; F02D 2200/0606

See application file for complete search history.

(56) References Cited

U.S. PATENT DOCUMENTS

2010/0274467 A1* 10/2010 Hayami ..... F02D 41/2438 701/103
2013/0144507 A1* 6/2013 Lee ..... F02D 41/3854 701/103
2014/0165970 A1* 6/2014 Lee ..... F02D 41/221 123/495

FOREIGN PATENT DOCUMENTS

KR 1020130060616 A 6/2013
KR 10-2014-0078439 A 6/2014

* cited by examiner

*Primary Examiner* — Hieu T Vo
*Assistant Examiner* — Sherman Manley
(74) *Attorney, Agent, or Firm* — Morgan, Lewis & Bockius LLP

(57) ABSTRACT

A low pressure fuel pump control system of a GDI engine may include a low pressure fuel pump primarily pressurizing fuel supplied from a fuel tank, a high pressure fuel pump secondarily pressurizing fuel from the low pressure fuel pump, a low pressure fuel pump pressure sensor and a high pressure fuel pump pressure sensor detecting fuel pressure of the low pressure fuel pump and the high pressure fuel pump, and a fuel supply pressure controller setting a final target pressure of the low pressure fuel pump by correcting a reference pressure, wherein the reference pressure is corrected by a low pressure correcting pressure according to temperature of the low pressure fuel pump and a correction pressure.

10 Claims, 4 Drawing Sheets

CONTROL SYSTEM OF LOW PRESSURE FUEL PUMP FOR GASOLINE DIRECT INJECTION ENGINE AND METHOD THEREOF

CROSS-REFERENCE TO RELATED APPLICATION

The present application claims priority to and the benefit of Korean Patent Application No. 10-2013-0144500 filed on Nov. 26, 2013, the entire contents of which is incorporated herein for all purposes by this reference.

BACKGROUND OF THE INVENTION

Field of the Invention

The present invention relates to a control system of a low pressure fuel pump for a gasoline direct injection (GDI) engine and a method thereof. More particularly, the present invention relates to a control system of a low pressure fuel pump for a GDI engine and a method thereof that prevents an engine from being turned off and improves driving performance by setting fuel pressure according to various internal and external environments.

Description of Related Art

A gasoline direct injection (GDI) engine is a gasoline engine in which fuel is directly injected into a combustion chamber. In order to directly inject fuel into a combustion chamber, the GDI engine boosts pressure of a fuel that is supplied from a low pressure fuel pump that is installed in a fuel tank at a high pressure fuel pump, and supplies the fuel to an injector.

The gasoline direct injection engine includes a low pressure system and a high pressure system. The low pressure system includes a low pressure fuel pump, a fuel pump controller, and a fuel pressure sensor. The high pressure system includes a high pressure adjustment valve, a high pressure fuel pump, a pressure sensor, and an injector.

In the GDI engine system, because fuel should be injected at a high pressure into a combustion chamber, the fuel supply system further pressurizes fuel that is primarily pressurized in the low pressure system in the high pressure system. Fuel that is pressurized in the high pressure system is directly injected into a combustion chamber through an injector.

The GDI engine system is classified into a variable flow control method GDI engine system and a fixed flow method GDI engine system.

FIG. 1 is a schematic diagram of a fuel pump controller that is applied to the variable flow control method GDI engine system.

The variable flow control method GDI engine system performs flow control of a low pressure fuel pump with a proportional, integral, and derivative (PID) feedback control method based on a target fuel pressure value that is received from an engine control unit (ECU) and an actually measured fuel pressure value that is measured in a low pressure fuel pump.

Therefore, a flow amount that is supplied from the low pressure fuel pump of the variable flow control method GDI engine system is supplied only by the sum of a fuel pump driving minimum fuel amount and a consumed amount necessary for a present engine.

Such a variable flow control method can minimize a current amount of fuel supplied by a fuel pump, compared with a fixed flow method of always supplying a maximum fuel amount, and can obtain a fuel consumption enhancement effect.

When almost all of a general driving area is driven with a fuel pressure (e.g., 2.5 bar) of a relatively low pressure fuel pump, a vehicle to which the variable flow control method GDI engine system is applied can maximize a fuel consumption enhancement effect.

However, vapor lock occurs when an excessively low pressure pump is used in various external environments such as a fuel, altitude, and temperature of the air, and thereby the engine quits and driving performance is deteriorated.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing a control system of a low pressure fuel pump for a GDI engine and a method that prevents an engine from cutting out or driving performance from being deteriorated by setting fuel pressure while the vehicle is driven according to various internal and external environments.

In an aspect of the present invention, a low pressure fuel pump control system of an gasoline direct injection (GDI) engine, may include a low pressure fuel pump primarily pressurizing fuel supplied from a fuel tank, a high pressure fuel pump secondarily pressurizing the fuel from the low pressure fuel pump, a low pressure fuel pump pressure sensor and a high pressure fuel pump pressure sensor detecting fuel pressure of the low pressure fuel pump and the high pressure fuel pump respectively, and a fuel supply pressure controller setting a final target pressure of the low pressure fuel pump by correcting a reference pressure, wherein the reference pressure is corrected by a low pressure correcting pressure according to temperature of the low pressure fuel pump, and a correction pressure.

The reference pressure is set as a maximum value between a low pressure pump target pressure and a base target pressure according to an operation region of a vehicle, wherein the low pressure pump target pressure is determined by a relationship of fuel temperature of the high pressure fuel pump and atmospheric pressure.

The low pressure correcting pressure increases according to an increment of temperature of the low pressure fuel pump.

The correction pressure is set from a relationship of temperature in the fuel tank, fuel level, and slope of evaporating pressure of fuel, and an evaporating pressure slope of the fuel.

The correction pressure increases according to an increment of the fuel level of the fuel tank, and decreases according to an increment of an evaporating pressure slope of the fuel.

The reference pressure is corrected by adding the low pressure correcting pressure to the reference pressure and subtracting the correction pressure from the reference pressure.

The reference pressure is corrected by the correction pressure when vehicle speed is higher than a predetermined value and a fuel level change rate of the fuel tank is higher than a predetermined value.

In another aspect of the present invention, a low pressure fuel pump control method of an gasoline direct injection (GDI) engine that directly injects primarily pressurized fuel in a low pressure system having a low pressure fuel pump to a combustion chamber through an injector by secondarily pressurizing in a high pressure system having a high pressure fuel pump, may include receiving an input of vehicle information for controlling the low pressure fuel pump, determining whether a vehicle speed and a fuel level change rate of a fuel tank are higher than predetermined values respectively, determining an evaporating pressure slope of fuel in the fuel tank when the vehicle speed and the fuel level change rate are less than the predetermined values respectively, determining a low pressure pump target pressure, a low pressure correcting pressure, and a correction pressure, the low pressure pump target pressure determined by a relationship of fuel temperature of the high pressure fuel pump and atmospheric pressure, the low pressure correcting pressure determined by internal temperature of the low pressure fuel pump, and the evaporating pressure slope determined by a relationship of temperature in the fuel tank, a fuel level of the fuel tank, and a slope of evaporating pressure of the fuel, and determining a final low pressure pump fuel pressure by correcting a maximum value between a base target pressure and the low pressure pump target pressure, wherein the maximum value is corrected by the low pressure correcting pressure and the correction pressure.

The final low pressure pump fuel pressure is determined by adding the low pressure correcting pressure to the maximum value and subtracting the correction pressure from the maximum value.

Correction of the correction pressure is not performed when a vehicle speed and a fuel level change rate are higher than predetermined values.

The low pressure fuel pump control method may further include receiving failure information of the high pressure fuel pump, boosting a fuel pressure of the low pressure fuel pump to a setting pressure when the high pressure fuel pump may have failed, based on the failure information, and boosting, when the high pressure fuel pump may have not failed, fuel pressure of the low pressure fuel pump to a setting pressure when a difference of a target pressure of the high pressure fuel pump and measured fuel pressure are more than a predetermined value.

The low pressure fuel pump control method may further include receiving failure information of the high pressure fuel pump, boosting fuel pressure of the low pressure fuel pump to a setting pressure when the high pressure fuel pump may have failed, based on the failure information, and boosting, if the high pressure fuel pump may have not failed, fuel pressure of the low pressure fuel pump to a setting pressure when a control value of a spill valve for controlling injecting timing of fuel is changed to a predetermined value or more.

The methods and apparatuses of the present invention may have other features and advantages which will be apparent from or are set forth in more detail in the accompanying drawings, which are incorporated herein, and the following Detailed Description, which together serve to explain certain principles of the present invention.

Figure 1:
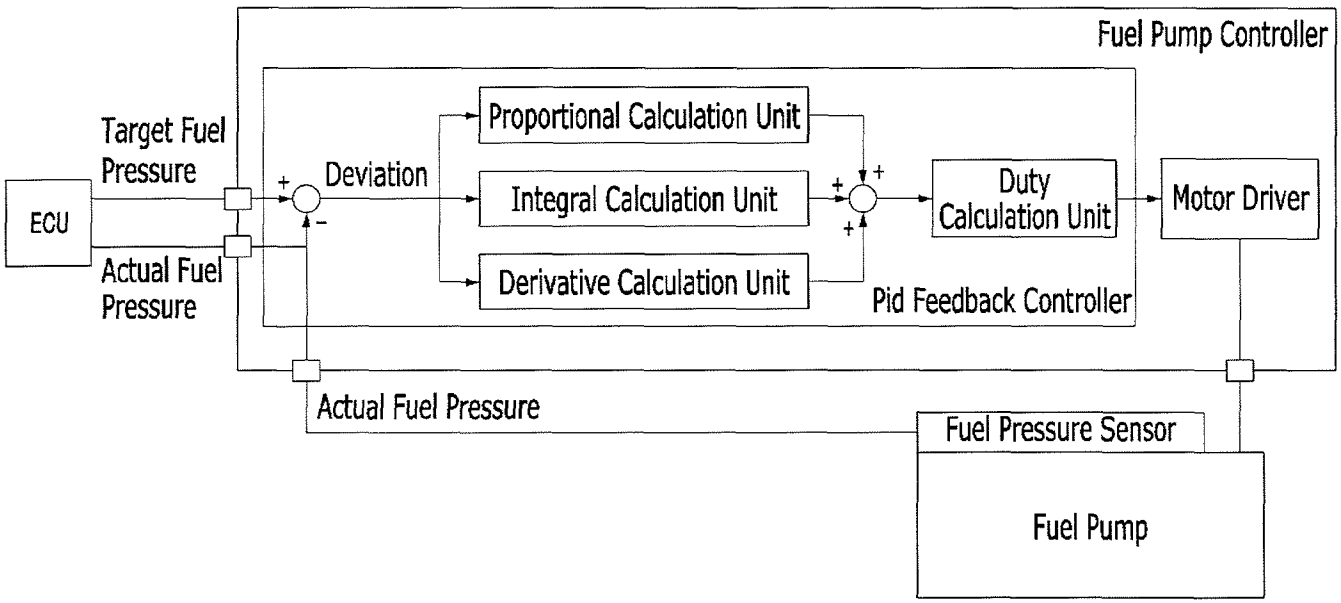
FIG. 1 (Related Art)
FIG. 1 is a block diagram illustrating a general GDI engine system.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

In the following detailed description, only certain exemplary embodiments of the present invention have been shown and described, simply by way of illustration.

As those skilled in the art would realize, the described embodiments may be modified in various different ways, all without departing from the spirit or scope of the present invention.

The drawings and description are to be regarded as illustrative in nature, and not restrictive. Like reference numerals designate like elements throughout the specification.

In the drawings, the sizes and thicknesses of the components are merely shown for convenience of explanation, and therefore the present invention is not necessarily limited to the illustrations described and shown herein.

Figure 2:
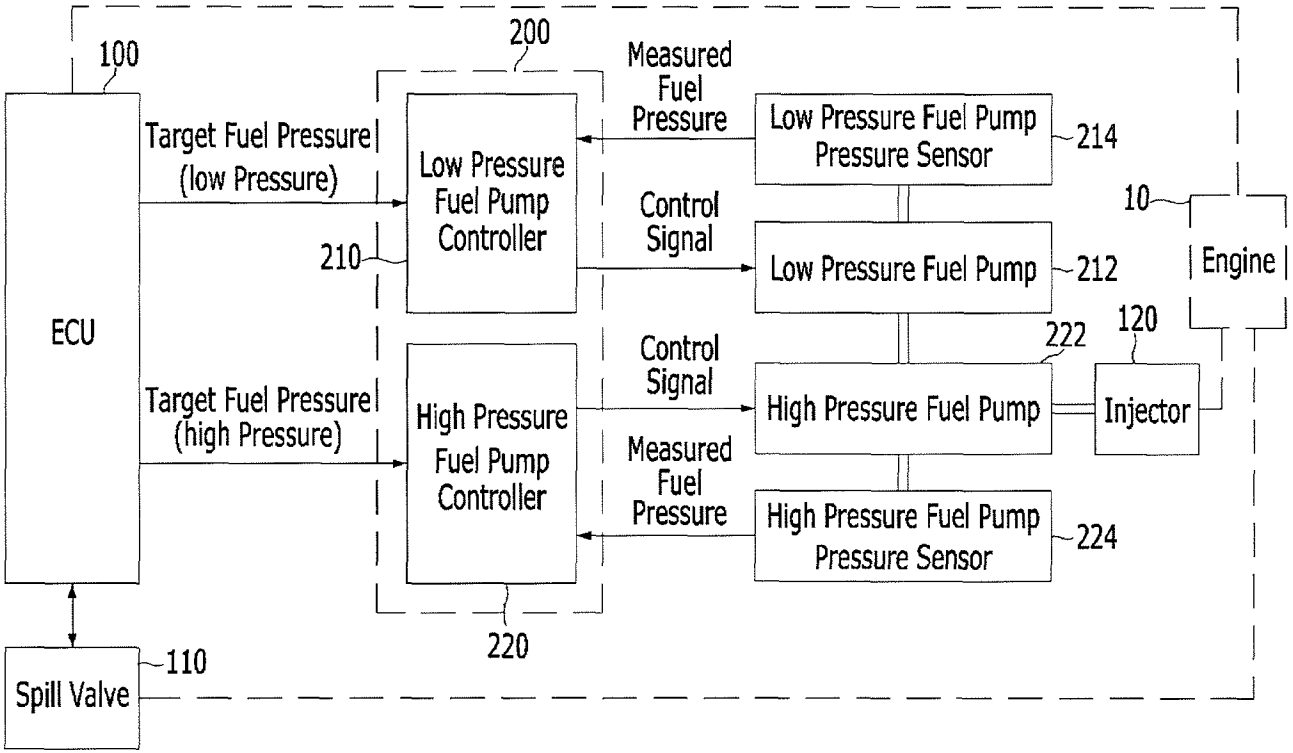
FIG. 2 is a block diagram illustrating a configuration of a low pressure fuel pump control system of a GDI engine according to an exemplary embodiment of the present invention.

FIG. 2 is a block diagram illustrating a configuration of a low pressure fuel pump control system of a GDI engine according to an exemplary embodiment of the present invention.

As shown in FIG. 2, a low pressure fuel pump control system of a GDI engine according to an exemplary embodiment of the present invention includes an engine control unit 100 that controls a GDI engine 10, a low pressure fuel pump pressure sensor 214 that detects a fuel pressure of a low pressure fuel pump 212, a high pressure fuel pump pressure sensor 224 that detects a fuel pressure of a high pressure fuel pump 222, a spill valve 110 that controls injection timing of fuel injected to a combustion chamber, an injector 120 that injects fuel to the combustion chamber, and a fuel supply pressure controller 200 that controls a fuel pressure of the low pressure fuel pump 212 according to a state of the high pressure fuel pump 222 and a control state of the GDI engine 10.

In FIG. 2, constituent elements other than the fuel supply pressure controller 200 are included in a general GDI engine system, and therefore a detailed description thereof will be omitted.

The fuel supply pressure controller 200 includes a low pressure fuel pump controller 210 and a high pressure fuel pump controller 220.

The fuel supply pressure controller 200 includes at least one microprocessor and/or hardware operating by a predetermined program, and the predetermined program may be formed with a series of commands for performing a method of controlling a low pressure fuel pump of a GDI engine according to an exemplary embodiment of the present invention to be described later.

That is, the fuel supply pressure controller 200 may be formed in a module form in which a program and hardware are combined. For example, the fuel supply pressure controller 200 may be a microprocessor, electrical and electronic components, and a PCB that mounts a memory element (ROM, RAM) in which a method of an exemplary embodiment of the present invention to be described later is stored as a program.

The fuel supply pressure controller 200 sets a target pressure of the low pressure fuel pump 212. The target pressure is set from a reference pressure by correcting a low pressure correcting pressure and a correction pressure. Here, the low pressure correcting pressure is determined according to temperature of the low pressure fuel pump 212 detected by a temperature sensor.

The reference pressure is set as a maximum value between the low pressure pump target pressure and the base target pressure. As such, since the reference pressure is set as a maximum value between the low pressure pump target pressure and the base target pressure, possibility occurring vapor in fuel can be reduced.

The base target pressure is a setting pressure determined from a driving region of a vehicle by considering RPM or load of engine.

The low pressure pump target pressure is a setting pressure experimentally obtained from a relationship of fuel temperature of the high pressure fuel pump 222 detected by a temperature sensor and atmospheric pressure. The low pressure pump target pressure is determined to increase as internal temperature of the high pressure fuel pump 222 increases and to decrease as atmospheric pressure increases.

This is because a possibility of vapor occurring is increased as internal temperature of the high pressure fuel pump 222 is high and atmospheric pressure is low.

Fuel temperature is increased when the vehicle drives in a region of high temperature or a state of a high load. Therefore, vapor lock generated in the low pressure pump can be avoided by modeling and correcting internal temperature of the low pressure fuel pump 212. For this, the reference pressure is corrected by adding the low pressure correcting pressure.

The low pressure correcting pressure is determined to increase as internal temperature of the low pressure fuel pump 212 increases. That is, since a possibility of vapor occurring in fuel is increased as the internal temperature of the low pressure fuel pump 212 is increased, possibility occurring vapor in fuel can be reduced by adding the low pressure correcting pressure to the reference pressure.

Generally, fuel used in the vehicle has various Reid vapor pressures (RVP). The possibility of generating vapor in fuel is increased as the RVP increases, therefore correction for the RVP is needed.

For this, the reference pressure is corrected by subtracting the correction pressure from the reference pressure.

The correction pressure is determined from a relationship of a temperature in the fuel tank, a fuel level in the fuel tank, and an evaporating pressure slope of the fuel. The evaporating pressure slope of the fuel has a characteristic that it is inversely proportional to the fuel level in the fuel tank and is proportional to the RVP of the fuel. Therefore, the correction pressure is determined to increase as the fuel level in the fuel tank increases and to decrease as the evaporating pressure slope increases.

That is, since the possibility of vapor occurring in the fuel increases as the evaporating pressure slope of the fuel and the fuel level of the fuel increase, as described above, a correction pressure needs to be set and the reference pressure is corrected by subtracting the correction pressure from the reference pressure.

Hereinafter, a low pressure fuel pump control method of a GDI engine according to an exemplary embodiment of the present invention will be described in detail.

Figure 3:
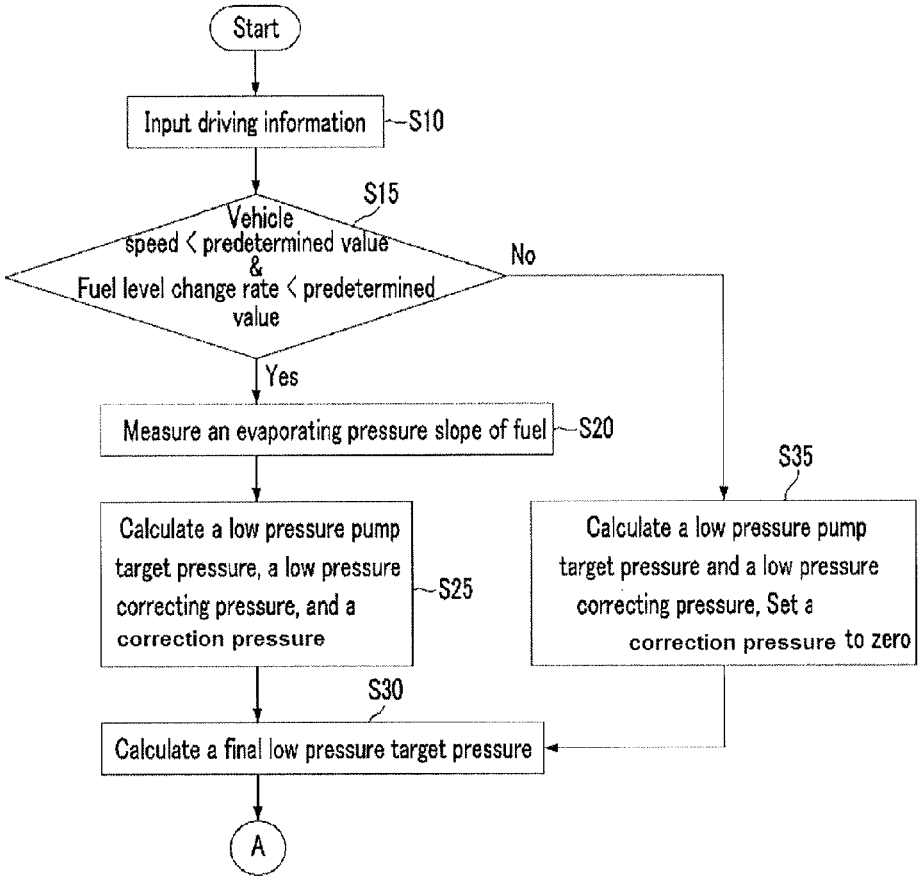
FIG. 3 is a flowchart illustrating a low pressure fuel pump control method of a GDI engine according to an exemplary embodiment of the present invention.
Figure 4:
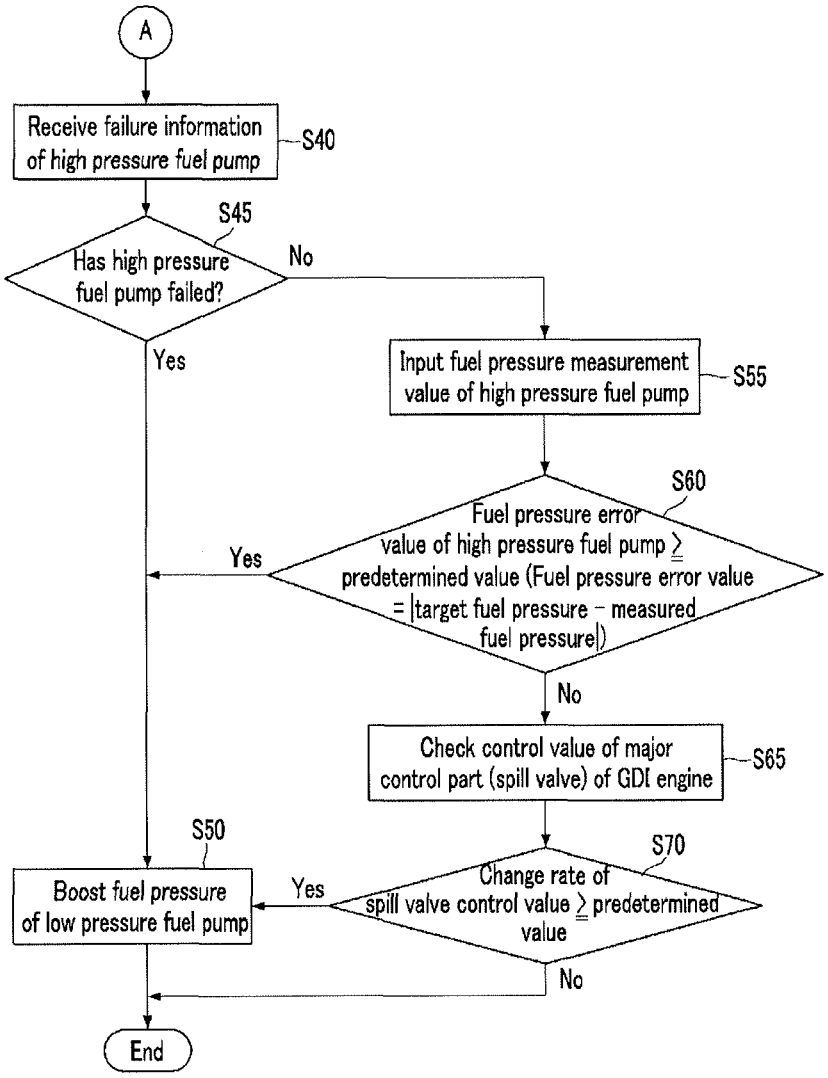
FIG. 4 is a flowchart illustrating a low pressure fuel pump control method of a GDI engine according to an exemplary embodiment of the present invention.

FIG. 3 and FIG. 4 form a flowchart illustrating a low pressure fuel pump control method of a GDI engine according to an exemplary embodiment of the present invention.

As shown in FIG. 3 and FIG. 4, the fuel supply pressure controller 200 receives overall information of the vehicle for controlling the low pressure fuel pump 212 at step S10. Overall information of the vehicle includes temperatures of the high pressure fuel pump 222 and the low pressure fuel pump 212, a negative pressure of the fuel tank, a fuel level of the fuel tank, a vehicle speed, and a fuel level change rate.

The fuel supply pressure controller 200 determines whether the vehicle speed and the fuel level change rate are higher than predetermined values at step S15.

If the vehicle speed and the fuel level change rate are less than the predetermined values, the fuel supply pressure controller 200 measures an evaporating pressure slope of fuel in the fuel tank at step S20.

The fuel supply pressure controller 200 calculates a low pressure pump target pressure by considering a relationship of the fuel temperature of the high pressure fuel pump 222 and atmospheric pressure. The fuel supply pressure controller 200 calculates a low pressure correcting pressure by using the internal temperature of the low pressure fuel pump 212. The fuel supply pressure controller 200 calculates a correction pressure from the relationship of temperature of the fuel tank, the fuel level, and the evaporating pressure slope of fuel at step S25.

At this time, a reference pressure is set as a maximum value between the low pressure pump target pressure and the base target pressure.

The fuel supply pressure controller 200 calculates a final low pressure target pressure by adding the low pressure correcting pressure to the reference pressure and subtracting the correction pressure from the reference pressure at step S30.

If the vehicle speed and the fuel level change rate are higher than predetermined values, the fuel supply pressure controller 200 calculates a low pressure pump target pressure by considering the relationship of the fuel temperature of the high pressure fuel pump 222 and atmospheric pressure. The fuel supply pressure controller 200 calculates a low pressure correcting pressure by using internal temperature of the low pressure fuel pump 212. The correction pressure is set to zero at step S35.

The vehicle speed and the fuel level change rate being higher than zero means the vehicle drives fast or there is a lot of rolling of the vehicle, so the evaporating pressure change rate of fuel cannot be calculated correctly. Therefore, the correction pressure is set to zero.

The fuel supply pressure controller 200 calculates a final low pressure target pressure by adding the low pressure correcting pressure to the calculated reference pressure and subtracting the correction pressure from the reference pressure return to step S30.

The fuel supply pressure controller 200 receives failure information of the high pressure fuel pump 22 at step S40.

The fuel supply pressure controller 200 determines whether the high pressure fuel pump 222 has failed or not based on the failure information at step S45.

If the fuel supply pressure controller 200 determines that the high pressure fuel pump 222 has failed, the fuel supply pressure controller 200 boosts fuel pressure of the low pressure fuel pump 212 at step S50. At this time, the fuel supply pressure controller 200 may boost fuel pressure, for example, from 2.5 bar to 5.0 bar.

If the fuel supply pressure controller 200 determines that the high pressure fuel pump 222 has not failed, the fuel supply pressure controller 200 receives fuel pressure of the high pressure fuel pump 222 measured by the high pressure fuel pump pressure sensor 224 at step S55.

When fuel pressure of the high pressure fuel pump 222 is input to the fuel supply pressure controller 200, the fuel supply pressure controller 200 calculates a difference (or error) between a target fuel pressure and the measured fuel pressure, and determines if the difference is more than a predetermined value (for example, 10 bar) at step S60. At this time, the difference is a fuel pressure error of the high pressure fuel pump.

If the fuel pressure error of the high pressure fuel pump is more than the predetermined value, the fuel pressure is reduced by abnormal control of the high pressure fuel pump. Therefore, the fuel supply pressure controller 200 boosts fuel pressure of the low pressure fuel pump 212 through the low pressure fuel pump controller 210 at step S50.

Meanwhile, the fuel supply pressure controller 200 may boost the fuel pressure of the low pressure fuel pump 212 when the fuel pressure of the high pressure fuel pump 222 is less than a predetermined value (for example, 30 bar).

If the difference is less than a predetermined value (for example, 10 bar), the fuel supply pressure controller 200 checks a control value of a major control part of the GDI engine at step S65. The major control part of the GDI engine may be, for example, a spill valve 110. The control value of the spill valve 110 may be an integral control gain value.

The reason why the fuel supply pressure controller 200 determines an integral control gain value of the spill valve 110 is that when a change rate of the integral control gain value of the spill valve 110 is larger than a predetermined value (e.g., a common control level change rate value), it represents a symptom in which a failure occurs in a high pressure side fuel pressure control.

When the fuel supply pressure controller 200 determines the control value of the spill valve 110, the fuel supply pressure controller 200 determines whether a change rate of the control value is equal to or larger than the predetermined value at step S70.

If the change rate of the control value is equal to or larger than the predetermined value, this represents a symptom in which a failure occurs in a high pressure side fuel pressure control, and therefore the fuel supply pressure controller 200 boosts a fuel pressure of the low pressure fuel pump 212 through the low pressure fuel pump controller 210 at step S50.

As described above, the characteristic of the present invention is that the low pressure fuel pump 212 of the low pressure system is variably controlled by compensating the low pressure correcting pressure and the correction pressure to the reference pressure. When the low pressure fuel pump is controlled according to various internal and external environments, vapor lock in the fuel system can be avoided and driving performance can be improved.

According to an exemplary embodiment of the present invention, cutting out of an engine can be prevented and fuel consumption can be reduced by setting the fuel pressure while the vehicle is driven according to various internal and external environments.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. They are not intended to be exhaustive or to limit the invention to the precise forms disclosed, and obviously many modifications and variations are possible in light of the above teachings as well as various alternatives and modifications thereof. It is intended that the scope of the invention be defined by the Claims appended hereto and their equivalents.

What is claimed is:

1. A low pressure fuel pump control system of an gasoline direct injection (GDI) engine, comprising:

a low pressure fuel pump primarily pressurizing fuel supplied from a fuel tank;

a high pressure fuel pump secondarily pressurizing the fuel from the low pressure fuel pump;

a low pressure fuel pump pressure sensor and a high pressure fuel pump pressure sensor detecting fuel pressure of the low pressure fuel pump and the high pressure fuel pump respectively; and a fuel supply pressure controller setting a final target pressure of the low pressure fuel pump by correcting a predetermined pressure, wherein the predetermined pressure is corrected by a low pressure correcting pressure according to a correcting pressure and a temperature of the low pressure fuel pump detected by a low pressure fuel pump temperature sensor, wherein the correction pressure is set from a relationship of fuel level and an evaporating pressure slope of the fuel, and wherein the fuel supply pressure controller is configured to increase the correction pressure according to an increment of the fuel level of the fuel tank, and configured to decrease according to an increment of the evaporating pressure slope of the fuel.

2. The low pressure fuel pump control system of the GDI engine of claim 1, wherein the predetermined pressure is set as a maximum value between a low pressure pump target pressure and a base target pressure according to an operation region of a vehicle, and wherein the low pressure pump target pressure is determined by a relationship of fuel temperature of the high pressure fuel pump detected by a high pressure fuel pump temperature sensor and atmospheric pressure.

3. The low pressure fuel pump control system of the GDI engine of claim 1, wherein the low pressure correcting pressure increases according to an increment of the temperature of the low pressure fuel pump.

4. The low pressure fuel pump control system of the GDI engine of claim 1, wherein the predetermined pressure is corrected by adding the low pressure correcting pressure to the predetermined pressure and subtracting the correction pressure from the predetermined pressure.

5. The low pressure fuel pump control system of the GDI engine of claim 1, wherein the predetermined pressure is corrected by the correction pressure when vehicle speed is higher than a predetermined value and a fuel level change rate of the fuel tank is higher than a predetermined value.

6. A low pressure fuel pump control method of an gasoline direct injection (GDI) engine that directly injects primarily pressurized fuel in a low pressure system having a low pressure fuel pump to a combustion chamber through an injector by secondarily pressurizing in a high pressure system having a high pressure fuel pump, the method comprising:

receiving, by a controller, an input of vehicle information for controlling the low pressure fuel pump;

determining, by the controller, whether a vehicle speed and a fuel level change rate of a fuel tank are higher than predetermined values respectively;

determining, by the controller, an evaporating pressure slope of fuel in the fuel tank when the vehicle speed and the fuel level change rate are less than the predetermined values respectively;

determining, by the controller, a low pressure pump target pressure, a low pressure correcting pressure, and a correction pressure, the low pressure pump target pressure determined by a relationship of fuel temperature of the high pressure fuel pump and atmospheric pressure, the low pressure correcting pressure determined by internal temperature of the low pressure fuel pump, wherein the correction pressure is determined by a relationship of a fuel level of the fuel tank and the evaporating pressure slope of the fuel and wherein the correction pressure is determined by the controller to increase according to an increment of the fuel level of the fuel tank, and to decrease according to an increment of the evaporating pressure slope of the fuel; and determining, by the controller, a final low pressure pump fuel pressure by correcting a maximum value between a base target pressure and the low pressure pump target pressure, wherein the maximum value is corrected by the low pressure correcting pressure and the correction pressure.

7. The low pressure fuel pump control method of the GDI engine of claim 6, wherein the final low pressure pump fuel pressure is determined, by the controller, by adding the low pressure correcting pressure to the maximum value and subtracting the correction pressure from the maximum value.

8. The low pressure fuel pump control method of the GDI engine of claim 6, wherein correction of the correction pressure is not performed when the vehicle speed and the fuel level change rate are higher than the predetermined values.

9. The low pressure fuel pump control method of the GDI engine of claim 6, further comprising:

receiving, by the controller, failure information of the high pressure fuel pump;

boosting, by the controller, a fuel pressure of the low pressure fuel pump to a setting pressure when the high pressure fuel pump has failed, based on the failure information; and boosting, by the controller, when the high pressure fuel pump has not failed, fuel pressure of the low pressure fuel pump to a setting pressure when a difference of a target pressure of the high pressure fuel pump and a measured fuel pressure of the high pressure fuel pump are more than a predetermined value.

10. The low pressure fuel pump control method of the GDI engine of claim 6, further comprising:

receiving, by the controller, failure information of the high pressure fuel pump;

boosting, by the controller, fuel pressure of the low pressure fuel pump to a setting pressure when the high pressure fuel pump has failed based on the failure information; and boosting, by the controller, if the high pressure fuel pump has not failed, fuel pressure of the low pressure fuel pump to a setting pressure when a control value of a spill valve for controlling injecting timing of fuel is changed to a predetermined value or more.

* * * * *